US012000248B2

(12) United States Patent
Harestad

(10) Patent No.: US 12,000,248 B2
(45) Date of Patent: Jun. 4, 2024

(54) GAS LIFT VALVE

(71) Applicant: PETROLEUM TECHNOLOGY COMPANY AS, Stavanger (NO)

(72) Inventor: Kristian Harestad, Stavanger (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 172 days.

(21) Appl. No.: 17/616,872

(22) PCT Filed: Jun. 5, 2020

(86) PCT No.: PCT/NO2020/050144

§ 371 (c)(1),
(2) Date: Dec. 6, 2021

(87) PCT Pub. No.: WO2020/246896

PCT Pub. Date: Dec. 10, 2020

(65) Prior Publication Data

US 2022/0162928 A1 May 26, 2022

(30) Foreign Application Priority Data

Jun. 6, 2019 (NO) ..... 20190703

(51) Int. Cl.
*E21B 43/12* (2006.01)
*E21B 21/10* (2006.01)
*E21B 34/10* (2006.01)

(52) U.S. Cl.
CPC ..... *E21B 43/123* (2013.01); *E21B 21/10* (2013.01); *E21B 34/10* (2013.01)

(58) Field of Classification Search
CPC ..... E21B 21/10; E21B 34/10; E21B 43/123; E21B 43/1235; E21B 43/13; E21B 24/16; E21B 21/103; E21B 21/106
See application file for complete search history.

(56) References Cited

U.S. PATENT DOCUMENTS

2011/0203805 A1* 8/2011 Kritzler ..... E21B 34/08 166/373
2015/0330183 A1 11/2015 Sevheim et al.
2016/0145981 A1* 5/2016 Qi ..... E21B 43/123 166/321

FOREIGN PATENT DOCUMENTS

NO 20171719 A1 4/2019
WO 2009038467 A1 3/2009
(Continued)

OTHER PUBLICATIONS

International Search Report corresponding to related International Application No. PCT/NO2020/050144, dated Sep. 23, 2020, 3 pages.

(Continued)

*Primary Examiner* — Caroline N Butcher
(74) *Attorney, Agent, or Firm* — K&L Gates LLP

(57) ABSTRACT

A valve arrangement for injection of an injection fluid in a process fluid tubing, comprising an inlet part connectable to an injection fluid source, an outer housing that is connectable to a process fluid tubing and comprising at least one outlet opening that enables a fluid communication between an interior of the outer housing and a process fluid tubing, and a first valve device comprising a first valve member that is arranged in the outer housing and movable within the outer housing in a longitudinal direction, and said first valve member is arranged to control an inflow of injection fluid into the valve arrangement by being movable between a closed position and an open position.

15 Claims, 4 Drawing Sheets

(56) References Cited

FOREIGN PATENT DOCUMENTS

| | | | |
|---|---|---|---|
| WO | 2012156117 | A2 | 11/2012 |
| WO | 2020023184 | A1 | 1/2020 |

OTHER PUBLICATIONS

International Written Opinion corresponding to related International Patent Application No. PCT/NO2020/050144, dated Sep. 23, 2020, 6 pages.

Norwegian Search Report corresponding to related Norwegian Application No. 20190703, Report dated Dec. 17, 2019, 2 pages.

* cited by examiner

GAS LIFT VALVE

CROSS REFERENCE TO RELATED APPLICATIONS

The present application is a National Stage of International Application No. PCT/NO2020/050144, filed on Jun. 5, 2020, which claims priority to Norwegian Patent Application No. 20190703, filed on Jun. 6, 2019, the entire contents of each of which are being incorporated herein by reference.

TECHNICAL FIELD

The present disclosure relates to a valve arrangement for injection of an injection fluid in a process fluid, a method for operating a valve arrangement.

The present disclosure further relates to a side pocket mandrel for use in a hydrocarbon well comprising an annulus and a tubing, and said side pocket mandrel comprising a valve arrangement.

BACKGROUND

An oil and/or gas well is drilled into a hydrocarbon bearing earth formation, where the well is typically completed in order to allow hydrocarbon production from the formation. Such a formation may be comprised of several different layers, where each layer may contain one or more hydrocarbon components. Often, such a formation will also contain water, gas, etc. Due to this, the conditions of production, i.e. the amount of oil, gas, water and pressure in the formation, will generally vary through the different layers of the formation, and will also vary during the production lifetime of the well. This may require intervention in the well and for this, suitable equipment is required, such as valve systems.

One such type of equipment is gas lift valves. Hydrocarbon production often begins with sufficient pressure in the formation to force the hydrocarbons to the surface. As the production from the well continues, the reservoir usually loses pressure until sufficient production of hydrocarbons from the well is no longer provided by the formation pressure. In some wells, the formation pressure as such is insufficient to support the production from the well already from the start.

Due to this, so-called artificial lift is often used to supplement the formation pressure to lift the hydrocarbons from the formation to the surface of the well. The basic idea for all artificial lifting systems is to extract more hydrocarbons out of the reservoir. One type of artificial lift system is a so-called gas lift system, where high pressure gas is injected into a production tubing of the well. In the gas lift system, the high pressure gas from the surface can for instance be supplied through a space, the so called annulus, located between the production tubing and a casing of the well. The gas enters the production tubing from the annulus side through one or more gas lift valves arranged along a length of the production tubing. The gas lift valve(s) may be positioned or arranged in the production tubing itself, or they may be arranged in so-called side pocket mandrels.

WO2009/038467 describes a gas lift shear open valve where the intention is to shear open and subsequently function as a normal valve. In an embodiment the intention of the valve is to act as a barrier element between annulus and tubing (safe closed) and at a desired stage the valve is pressurized open with an injection fluid and the pre-set closing arrangement of the valve is pressurized open. After opening the intention of the valve is to keep open at all time. A drawback of this valve is that it will shear when the well is pressure tested by pressurizing annulus. In a well with more than one shear valve activated with pressuring from annulus, it is then not possible to know if more than one valve has been sheared.

WO2012/156117 discloses a shear valve similar to WO2009/038467, but in which an obstruction device is provided such that the valve can be sheared open from the tubing side and thus allows pressurizing from annulus without the valve opening. The valve comprises an outer housing and an internal valve member movable in a longitudinal direction within the outer housing, between an open and a closed position, and an obstruction device obstructing the internal valve member from moving. The obstruction device can be deactivated by pressurizing the tubing side of the valve, and thereby setting the internal valve member free to move. The obstruction device is either a type of breakable sealing located outside of the outer housing, inside the tubing, and obstructing a communication port between the valve and the tubing, or a breakable filler material placed inside the outer housing, between the valve member and the communication port.

Other applications where downhole valve systems are required include chemical injection, i.e. systems for injecting chemicals into a well tubing and/or into the formation itself, and water injection valves, for example for waterflooding of reservoirs. Various other downhole operations may also require valve systems for which the present disclosure may be relevant.

Common for these valve systems is generally that they need to be compact and operationally reliable. With the current trend in the industry to explore more unconventional resources, and the continuous need for improved technical solutions for downhole tools, there is a need for improved valve systems, in particular suitable for downhole use in oil and gas wells. The present disclosure has the objective to provide a valve arrangement which provides advantages over known solutions and techniques.

SUMMARY

The above objective and other objectives are obtained by the arrangement and method of the present disclosure.

According to one example is provided a valve arrangement for injection of an injection fluid in a process fluid tubing, comprising:

an inlet part connectable to an injection fluid source, an outer housing that is connectable to a process fluid tubing and comprising at least one outlet opening that enables a fluid communication between an interior of the outer housing and a process fluid tubing, a first valve device comprising a first valve member that is arranged in the outer housing and movable within the outer housing in a longitudinal direction, and said first valve member is arranged to control a inflow of injection fluid into the valve arrangement by being movable between a closed position and an open position, characterised in that it comprises a second valve device comprising a second valve member that is arranged in the outer housing and movable within the outer housing in a longitudinal direction, and said second valve member is arranged to control the at least one outlet opening by being movable between a closed position, in which the at least one outlet opening is closed and the valve arrangement is in a deactivated state in which injection fluid cannot be injected in the process fluid tubing, and an open position, in which the at least one outlet opening is open and the valve arrangement is in an activated state that enables injection of injection fluid into the process fluid tubing, and a locking device that locks the second valve member in the closed position, and the locking device is releasable in order to allow the second valve member to be released to move to the open position.

By providing a second valve device with a second valve member that is arranged to control the at least one outlet opening by being movable between a closed position, in which the at least one outlet opening is closed, and this second valve member being arranged in the outer housing and being locked in the closed position by means of the locking device, is provided the advantage that no fluid from within the outer housing will be able to enter into the tubing until the locking device is released and thereby releasing the second valve member to move. This is e.g. an advantage when pressure testing an installed valve arrangement from the injection fluid pressure side. Pressure testing from the annulus side can be made without risking to open the valve arrangement to the process fluid tubing. The outlet opening being closed by the second valve member may also be described in terms of the second valve member blocking or obstructing the outlet opening.

By the valve arrangement being in its deactivated state is intended the state when the second valve member is in its closed and locked position, blocking the outlet opening such that said outlet opening is closed. By the valve arrangement being in its activated state is intended that the second valve member has been released from its locked position and is in an open position, such that the outlet opening is no longer blocked, but free and open, and it will thereby be possible to inject injection fluid into the process fluid tubing via the valve arrangement by opening the first valve device. The first valve device is usually a type of check valve that will open automatically when being pressurised from the injection fluid side, i.e when an injection fluid pressure exceeds the pressure from the process fluid having entered the housing, and which will close automatically, e.g. by means of a spring device, when there is no pressure from an injection fluid.

The locking device may be configured to be released at a predetermined pressure difference between a fluid pressure inside the outer housing, which has a hollow interior, and a fluid pressure in the process fluid tubing, which fluid pressure in the process tubing exceeds the fluid pressure inside the outer housing. The locking device may be configured such that it can be releasable by means of pressurizing across the second valve member. The locking device may for example be connected to the second valve member, or even engaged in or by the second valve member. The second valve member is exposed to the fluid pressure from the tubing in the outlet opening, and to the fluid pressure inside the outer housing. By having the described predetermined pressure difference across the second valve member, the resulting force will also affect the locking device such that the locking device will be released or broken and thereby deactivated. When the locking device has been released then the second valve member is also released from the closed position and is free to move to the open position. The locking device and the second valve member can thus be released by means of pressuring from the process fluid tubing side of the second valve member.

According to one example, the locking device comprises at least one shear member configured to shear at a predetermined shear force. This predetermined shear force can thus be based on the predetermined pressure difference. To have one or several shear members to function as a locking device is a simple and economic solution. Shear members can in a simple way be installed such that they connect the movable second valve member to a fixed component of the valve arrangement, and when the predetermined shear force is reached, the shear members will break and the second valve member is free to move. Such a fixed component may e.g. comprise the outer housing or a part of the valve device which part in turn is fixed to the outer housing. When determining the predetermined shear force it can then be based on the above described predetermined pressure difference, or vice versa. If there are several shear members, it will of course be their added predetermined shear forces that will be relevant in relation to the predetermined pressure difference. Usually, there would be at least two shear members, preferably arranged symmetrically in relation to the axis of movement of the second valve member. Examples of shear members are shear pin, shear sleeve, shear plate.

In one example, the at least one outlet opening in the outer housing is located in an end wall of the valve arrangement. By end wall is intended the wall located at an end in longitudinal direction of the outer housing. The end wall extends in a direction essentially perpendicular to the direction of movement of the first and second valve members, as opposed to side walls of the outer housing that extend in a longitudinal direction of the housing, parallel to the direction of movement of the first and second valve members. The end wall is configured to the insertable into the process fluid tubing. This has several advantages. If for example the valve arrangement is used in a side pocket mandrel installed between the annulus and the tubing in a hydrocarbon well, such a mandrel is usually inclined. In many such prior art valves the outlets are provided in the sidewall of the valve. Due to the inclination there will be uneven turbulence around the valve outlets that will affect the fluid outflow and it may even result in fluid being sucked backed into the valve from the tubing through some of the outlets. This problem can to a great extent be avoided by having the outlet or outlets in the end wall of the valve arrangement. The outlet opening may preferably have a size that matches presumed fluid outflow. If several outlet openings are provided, they may be arranged in a symmetrical pattern, preferably symmetrically arranged in relation to the axis of movement of the second valve member. However, it is emphasized that many of the disclosed details and functions would also be applicable and feasible for a valve arrangement having corresponding outlet openings in its sidewalls.

When the second valve member is in the open position, a fluid communication path is provided from the process tubing to the first valve member, via the at least one outlet opening in the housing and the second valve device.

The second valve device may comprise at least one fluid opening that, when the second valve member is in the open position, provides a fluid communication between the process fluid tubing, via the at least one outlet opening, and the first valve member. Such at least one fluid opening will provide fluid communication between an interior part of the outer housing, in which interior part the first valve member is located, and the process fluid tubing when the second valve member is in the open position. The second valve member may comprise the at least one fluid opening.

The second valve device may comprise an inner housing located inside the outer housing, wherein the second valve member is movable inside the inner housing. The inner housing thus has a hollow interior. At least one first stop member will usually be arranged in the inner housing, against which stop member the second valve member may abut in the open position. The first stop member will thus work to stop further movement of the second valve member inside the inner housing, after the second valve member having reached its open position. There will usually also be a second stop member that prevents that the valve member can move in the return direction. The second stop member may e.g. comprise a circlip or a lock ring.

The inner housing may be configured with an open end connected to the at least one outlet opening and the inner housing may comprise at least one fluid opening for allowing fluid communication between an interior of the inner housing and a surrounding interior of the outer housing. Thus a fluid communication path can be achieved from the outlet opening into the interior of the inner housing, out from the inner housing via the at least one fluid opening and into the surrounding interior of the outer housing and further into the outer housing where the first valve device is located.

According to one example, the valve arrangement comprises a holding device that holds the first valve member in an open position when the valve arrangement is in the deactivated state. It is not a requirement that the first valve member is held in an open position initially, but it has some advantages. When the first valve member is held open, there will be fluid communication between the injection fluid source and the interior of the outer housing. Consequently, there will be pressure equalization between these volumes. If for example the first valve member instead was to be closed initially, before deactivation/release of the locking device and opening of the second valve member, and the valve arrangement was subjected to heat, which would not be unusual for some applications, the volume inside the outer housing would be closed off and the pressure inside would rise. Such a situation can be avoided by keeping the first valve member open when the valve arrangement is in its deactivated state.

The holding device may couple the first valve member to the second valve device. This may be achieved by means of the holding device comprising a connector that connects the first valve member and the second valve member. Such a connector may be a resilient connector, for example a spring, which would provide for a simple and economic solution. As an alternative, the holding device may be a connector made of a breakable material that will be configured break when the locking device is released and the second valve member is released and starts moving towards the open position. The force exerted on the connector by the second valve member when it starts to move will cause it to break. It may e.g. be of a breakable glass material or ceramic material. It may e.g. be a pin that connects the first and second valve members.

Alternatively, the holding device may comprise a releasable coupling that couples the first valve member to the inner housing when the valve arrangement is in the deactivated state. The releasable coupling may be configured to be releasable by means of the second valve member, when the second valve member moves to its open position. The above described holding device of a breakable material may also be described as a releasable coupling.

In one example, the inner housing may has a through bore in the longitudinal direction comprising a first channel and a second channel. The first channel may be adapted to receive the second valve member when the second valve member moves to its open position. Further, the second valve member may have a shaft that extends into the second channel. The second channel may comprise a first channel part that has a length that essentially corresponds to the length of the shaft, and a second channel part in which elements of the holding device are arranged. The holding device may comprise an actuator that can be actuated by the shaft when the second valve member moves to its open position, whereby said actuator releases the coupling.

The first valve device of the described valve arrangement may comprise a dart check valve.

The described valve arrangement may be configured for use in a downhole tool, between an annulus and a tubing in a well, wherein the inlet part connectable to an injection fluid source is connectable to the annulus and the outlet part connectable to a process fluid tubing is connectable to the tubing in the well. The valve arrangement may be used as a gas lift valve in a gas lift mandrel and in particular in a side pocket mandrel.

According to an example is provided a side pocket mandrel for use in a hydrocarbon well comprising an annulus and a tubing, said side pocket mandrel comprising a valve arrangement as previously described, wherein the inlet part connectable to an injection fluid source is connectable to the annulus and the at least one outlet opening is connectable to the tubing in the well.

According to an example is provided a method for operating the described valve arrangement, which valve arrangement is in a deactivated state in which the second valve member is in its closed position, and which valve arrangement is connected via the inlet part to an injection fluid source and connected via the at least one outlet opening to a process fluid tubing, the method comprising activating the valve arrangement by applying a process fluid pressure in the process fluid tubing to exert a process fluid pressure force on the second valve member, whereby, when a predetermined pressure difference between a fluid pressure in the outer housing and a fluid pressure in the process fluid tubing is reached, which fluid pressure in the process fluid tubing exceeds the fluid pressure in the outer housing, the locking device is released and the second valve member is released to move to the open position, injecting injection fluid via the valve arrangement into the process fluid tubing, comprising opening of the first valve member.

Further features and advantages of the present disclosure will also become apparent from the following detailed description of embodiments.

BRIEF DESCRIPTION OF THE DRAWINGS

The present disclosure will now be described in more detail, with reference being made to the enclosed schematic drawings illustrating examples according to the present disclosure, and in which.

Elements that are the same or represent corresponding or equivalent elements have been given the same reference numbers in the different figures.

DETAILED DESCRIPTION

Figure 1C:
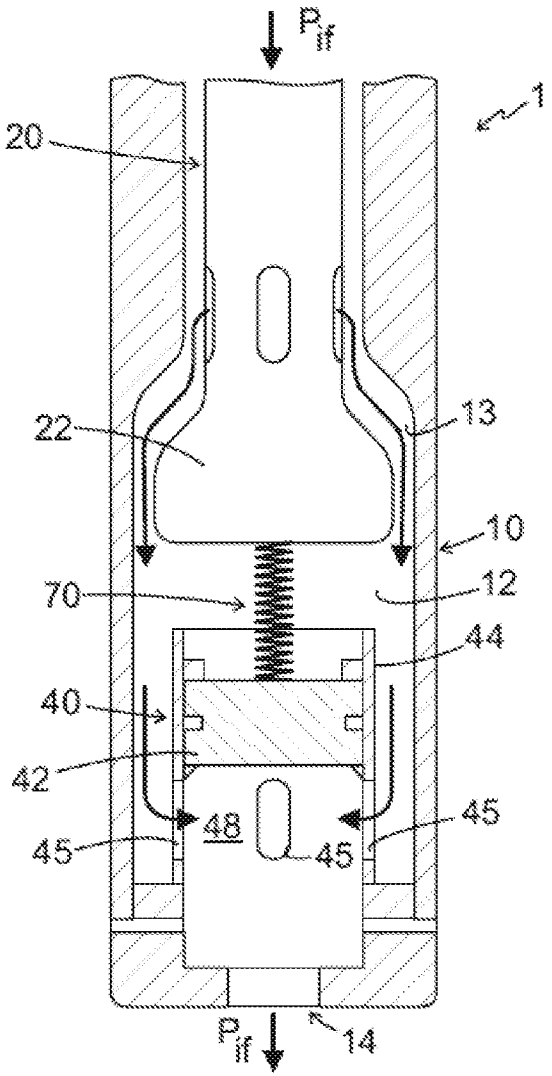
FIGS. 1*a*-1*c* illustrate a valve arrangement of a first example in three different operating positions, partly in cross section.

Reference is made to FIGS. 1*a*-1*c* and 2*a*-2*c* illustrating two examples of a valve arrangement for injection of an injection fluid in a process fluid tubing, in three different operating positions. In all examples the valve arrangement 1 comprises

- an inlet part 3 connectable to an injection fluid source,
- an outer housing 10 that is connectable to a process fluid tubing and comprising at least one outlet opening 14 that enables a fluid communication between an interior 12 of the outer housing and a process fluid tubing,
- a first valve device 20 comprising a first valve member 22 that is arranged in the outer housing 10 and movable within the outer housing in a longitudinal direction, and said first valve member 22 is arranged to control an inflow of injection fluid into the valve arrangement by being movable between a closed position and an open position.

The valve arrangement further comprises a second valve 40 device comprising

- a second valve member 42 that is arranged in the outer housing 10 and movable within the outer housing in a longitudinal direction, and said second valve member 42 is arranged to control the at least one outlet opening 14 by being movable between a closed position, in which the at least one outlet opening 14 is closed and the valve arrangement is in a deactivated state in which injection fluid cannot be injected in the process fluid tubing, and an open position, in which the at least one outlet opening 14 is open and the valve arrangement is in an activated state that enables injection of injection fluid into the process fluid tubing, and
- a locking device 60 that locks the second valve member 42 in the closed position, and the locking device is releasable in order to allow the second valve member be released to move to the open position.

The first valve member 22 generally provides a sealing function in the closed position by abutting against a first valve seat 24. The valve seat 24 may be arranged on the inside of the outer housing 10, as shown in the illustrated examples.

The first valve device 20 may be part of a check valve configuration and arranged to operate by means of a spring 22. The check valve may be of the dart check valve type. The first valve device 20 generally controls the inflow of injection fluid into the entire valve arrangement even though the first valve device may not be directly connected to an inlet connectable to the injection fluid source.

The second valve member 42 generally provides a sealing function in the closed position by abutting against a second valve seat 54. The valve seat 54 may be arranged in a recess provided in the outer housing wall or the valve seat may be arranged in the inner housing 44, to be described later. In the example, the second valve member generally has the shape of a short cylinder.

The locking device 60 may be arranged to be releasable or in other words it can be deactivated, such that it does no longer fulfil the locking function. The locking device may be arranged to be released at a predetermined deactivation pressure. In the example, the locking device 60 is configured to be released at a predetermined pressure difference between a fluid pressure $P_{oh}$ inside the outer housing 10 and a process fluid pressure $P_{pf}$ in the process fluid tubing, which process fluid pressure in the process tubing exceeds the fluid pressure inside the outer housing 10. It may thus be described as the deactivation pressure being reached from the tubing side.

The locking device 60 may comprise at least one shear member configured to shear at a predetermined shear force. The predetermined shear force may then be the force exerted by the predetermined pressure difference described above.

In one example, the at least one outlet opening 14 in the outer housing 10 is located in a longitudinal end wall 57 of the valve arrangement 1. By longitudinal end wall is intended an end wall that delimits the longitudinal extension of the valve arrangement, as opposed to sidewalls. Even though this is described as one example, it is not excluded that a variant can be foreseen in which an outlet opening or openings are provided in the sidewalls of the housing.

The second valve device 40 may comprise at least one fluid opening 45 that, when the second valve member 42 is in the open position, provides a fluid communication between the process fluid tubing and the first valve member 22, via the at least one outlet opening 14.

As shown in the first and second examples, the second valve device 40 may comprise an inner housing 44 located inside the outer housing 10, wherein the second valve member 42 is movable inside the inner housing. At least one first stop member 50 may be arranged in the inner housing 44, against which stop member the second valve member 42 may abut in the open position. Further, the inner housing 44 may have an open end 46 connected to the at least one outlet opening 14 and wherein the inner housing comprises at least one fluid opening 45 for allowing fluid communication between an interior 48 of the inner housing 44 and the surrounding interior 12 of the outer housing 10.

According to the illustrated examples, the first valve member 22 may be held open when the second valve member 42 is locked in the closed position by means of the locking device 60. The locking device 60 is thus in the activated state and the valve arrangement 1 as such is in the deactivated state. The first valve member 42 may be described as being biased in an open position when the valve arrangement is in the deactivated state. In order to achieve the holding open of the first valve member 22, the valve arrangement 1 may comprise a holding device 70 that holds the first valve member 22 in an open position when the valve arrangement is in the deactivated state. The holding device 70 may couple the first valve member 22 to the second valve device 40.

As shown in the first example, the holding device 70 may comprise a connector 72 that connects the first valve member 22 and the second valve member 42. The connector may be resilient. It may for example be a spring.

According to the second example, the holding device 70 may comprises a releasable coupling 74 that couples the first valve member 22 to the inner housing 44 when the valve arrangement is in the deactivated state. The releasable coupling may be configured to be releasable by means of the second valve member 42, when the second valve member moves to its open position. This is shown in FIG. 2*b* and will be explained later. The releasable coupling may for example be a quick release coupling.

As mentioned and according to an alternative, the holding device may be made of a breakable material that will be configured break when the locking device is released and the second valve member is released and starts moving towards the open position. The force exerted on the connector/coupling by the second valve member when it starts to move will cause it to break. It may e.g. be of a breakable glass material or ceramic material. It may e.g. be a pin that connects the first and second valve members.

According to any one of the examples, the first valve 20 device may comprise a dart check valve, as shown schematically in the figures.

Further details and functions will now be described.

Figure 1B:
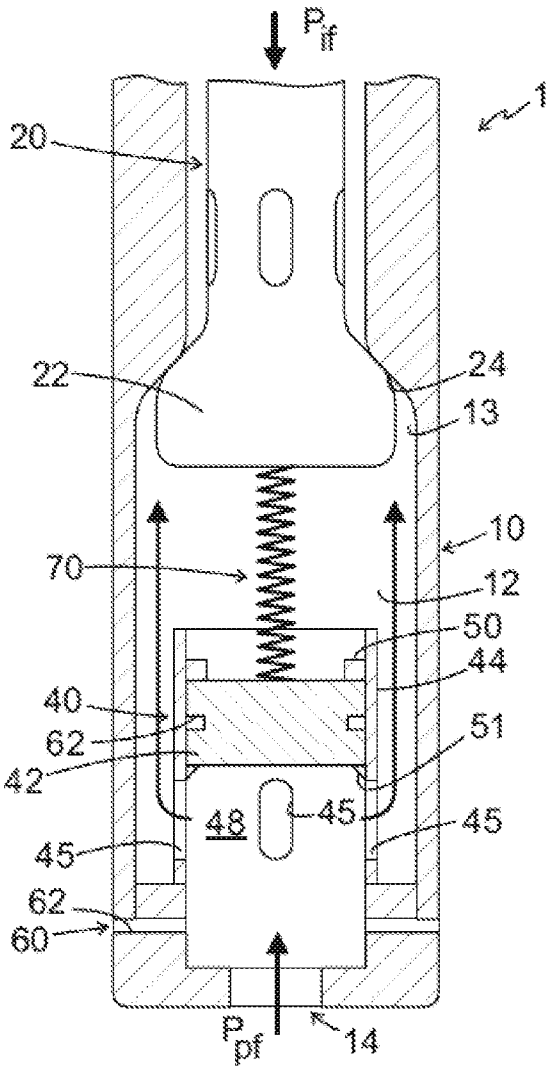
Figure 1A:
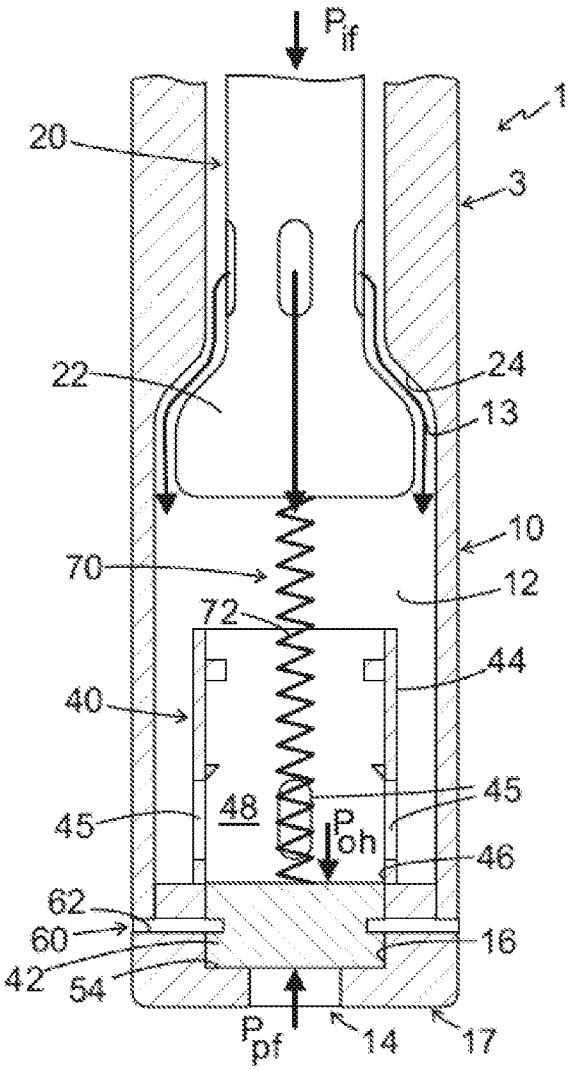

In FIG. 1*a* is shown a first example of a valve arrangement 1 comprising a first valve device 20 and a second valve device 40 located in a hollow space inside the outer housing 10. The outer housing has a hollow space that houses both the first valve device and the second valve device. The first valve device can be said to be located in a first part of the hollow space of the outer housing, and the second valve device can be said to be located in a second part of the hollow space of the outer housing. When in the following description reference is made to the interior 12 of the outer housing is intended the second part of the hollow space, except for when explicitly stated otherwise. The valve arrangement is shown when it is in a deactivated state, i.e. when the locking device 60 is activated and the second valve member 42 of the second valve device 40 is locked by the locking device 60 in a closed position. The outer housing comprises an outlet opening 14 that is located in a longitudinal end wall 17 of the outer housing. In the shown example, the second valve member 42 rests and seals against a second valve seat 54 provided on the inside of the outer housing 10, in the vicinity of the outlet opening 14. In the shown example, the second valve member 42 rests, when it is locked and closed, in a recess 16 formed in the end wall 17 of the outer housing, on its inside, and in which recess the valve seat 54 is arranged. The outlet opening 14 can be described as a prolongation of that recess, however with a smaller cross section. When the valve arrangement is connected to a process fluid tubing, the outlet opening 14 opens out into the process fluid tubing.

In the closed state, the second valve member 42 blocks the outlet opening 14 such that no process fluid can enter from the process fluid tubing and into the valve arrangement and no injection fluid can enter the process fluid tubing from the valve arrangement. A seal member may be provided at or close to the valve seat 54 (not illustrated). In the shown example, the locking device 60 comprises two or more shear members 62 that connect the second valve member 42 to the outer housing 10. The locking device locks the second valve member to the outer housing as long as the predetermined shear force is not exceeded. The shear members 62 are inserted into respective corresponding grooves in the second valve member and the wall of the outer housing in the recess 16. In the illustrated example, the shear members are shown as shear pins/screws, but also other types of shear members are possible, e.g. shear sleeve, shear plate, as realized by the skilled person and with only minor modifications, if necessary.

The second valve device 40 further comprises an inner housing 44 located in the interior 12 of the outer housing 10. The inner housing 44 has an open end 46 at which it is connected to the outer housing and the outlet opening 14. The inner housing is located over the recess 16 and can be described as providing a prolongation of the recess for the second valve member to move up into the inner housing. When the shear members 62 are sheared and the second valve member 42 is released to move, it can move upwards inside the inner housing, as shown in FIG. 1*b*. The inner housing further comprises fluid openings 45 in its side wall. The fluid openings provide fluid communication between the interior 48 of the inner housing 44 and the surrounding interior 12 of the outer housing 10.

In the first example of the valve arrangement 1 shown in FIG. 1*a*, is also shown the first valve device 20. In this example, the first valve device is illustrated as being of the dart check valve type, but also other types of check valves can be used. The first valve member 22 is shown to be in an open position when the second valve member 42 is closed, and it does not rest against the valve seat 24 provided on the inside of the outer housing. To arrange for the first valve member to be in the open position when the second valve member is closed is optional, but it provides an advantage since it will prevent pressure build up inside the interior 12 of the outer housing 10, e.g. due to heating. In order to keep the first valve member 22 in an open position there is provided an optional holding device 70 that connects the first valve member 22 and the second valve member 42. The holding device may comprise a spring 72 or any other type of suitable device, e.g. elastic or resilient. It may preferably be a spring that is in a stretched state when the second valve member 42 is closed, as illustrated. The spring may e.g. be a helical spring.

The valve arrangement 1 in FIG. 1*a* will remain closed by means of the second valve member 42 being locked in a closed position as long as a predetermined shear force $F_s$ for the shear members 62 is not reached. The shear members 62 are under influence from a first force and a second force. The first force is the force that a process fluid pressure $P_{pf}$ in the process fluid tubing exerts on a first area of the second valve member 42 which is exposed in the outlet opening 14 to the process fluid in the process fluid tubing. The second force is the force that the fluid pressure $P_{oh}$ inside the outer housing 10 exerts on a second area of the second valve member 42, which is exposed to the fluid pressure $P_{oh}$ inside the interior 12 of the outer housing 10. In the case when the first valve member 22 is in the open position, as in FIG. 1*a*, the fluid pressure $P_{oh}$ inside the interior 12 of the outer housing 10 will be the injection fluid pressure $P_{if}$, if the valve arrangement is connected to an injection fluid source. The first and second areas of the second valve member 42 are located on opposing sides of the valve member. The first force and the second force then have opposing directions. The second valve member 42 is only movable in one direction from the closed position, which is the direction away from the outlet opening 14. This movement can achieved by having a process fluid pressure $P_{pf}$ that exceeds the fluid pressure inside the housing $P_{oh}$, e.g. the injection fluid pressure $P_{if}$. Thus the locking device 60 is configured to be released at a predetermined pressure difference $P_\Delta$ between the fluid pressure inside the housing $P_{oh}$, e.g. the injection fluid pressure $P_{if}$, and the fluid pressure $P_{pf}$ in the process fluid tubing. The shear members 62 are configured to shear at a predetermined shear force based on the predetermined pressure difference $P_\Delta$.

When the predetermined pressure difference is reached, the shear members 62 will shear and the second valve member 42 will be released and pushed upwards/inwards, away from the outlet opening 14. Process fluid from the process fluid tubing can then enter into the outer housing 10, via the outlet opening 14 and the inner housing 44. In the first example of the valve arrangement, the second valve member 42 moves upwards, inside the inner housing 44 until it abuts against a first stop member 50 arranged inside the inner housing. The fluid openings 45 in the side wall of the inner housing 44 are now unblocked and process fluid enters via the outlet opening 14 into the interior 48 of the inner housing, from where the process fluid can continue to flow out through the fluid openings 45 and into the surrounding interior 12 of the outer housing 10. This is illustrated by arrows in FIG. 1*b*. If the first valve member 22 was originally open, it will now close due to the pressure force from the inflowing process fluid. The spring 72 of the holding device 70, which spring was in a stretched state when the second valve member was closed, will now be relieved from tension and retract, which may also assist in the closing of the first valve member 22. The locking device 60 has thus been deactivated and the valve arrangement is now in an activated state which means that it will open when subjected to a fluid pressure from an injection fluid source, to which it is connected, which pressure is high enough to open the first valve device 20.

In FIG. 1*c* is illustrated the first example of the valve arrangement in its open state. The injection fluid pressure $P_{if}$ exceeds the process fluid pressure $P_{pf}$ and the first valve member 22 will be pushed down into the interior 12 of the outer housing 10, to its open position. Injection fluid can then flow through the open first valve and into the interior 12 of the outer housing where the second valve device is located. Injection fluid can then continue to flow from the interior 12 of the outer housing into the inner housing 48, via the fluid openings 45, and further via the interior 48 of the inner housing out through the outlet opening 14 and into the process tubing to which it is connected. This is illustrated by the arrows in FIG. 1*c*. The second valve member 42 is preferably fixated in the open position by means of at least one second stop member 51 that is configured to allow for the second valve member 42 to bypass the second stop member on its way up but prevents the second valve member from moving back down. The second stop member 51 may e.g. comprise a circlip or a lock ring, e.g. a Seeger ring.

Figure 2C:
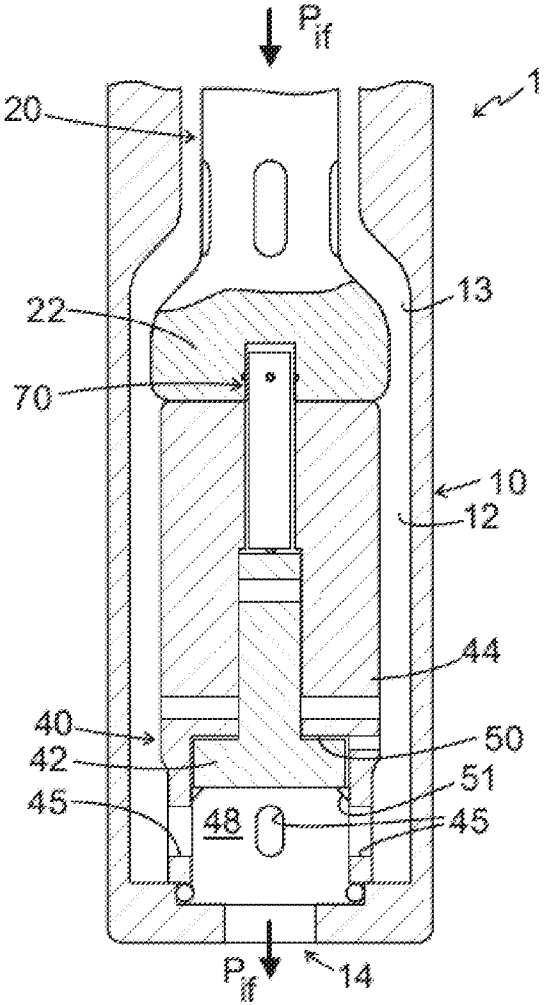
FIGS. 2*a*-2*c* illustrate a valve arrangement of a second example in three different operating positions, partly in cross section.
Figure 2B:
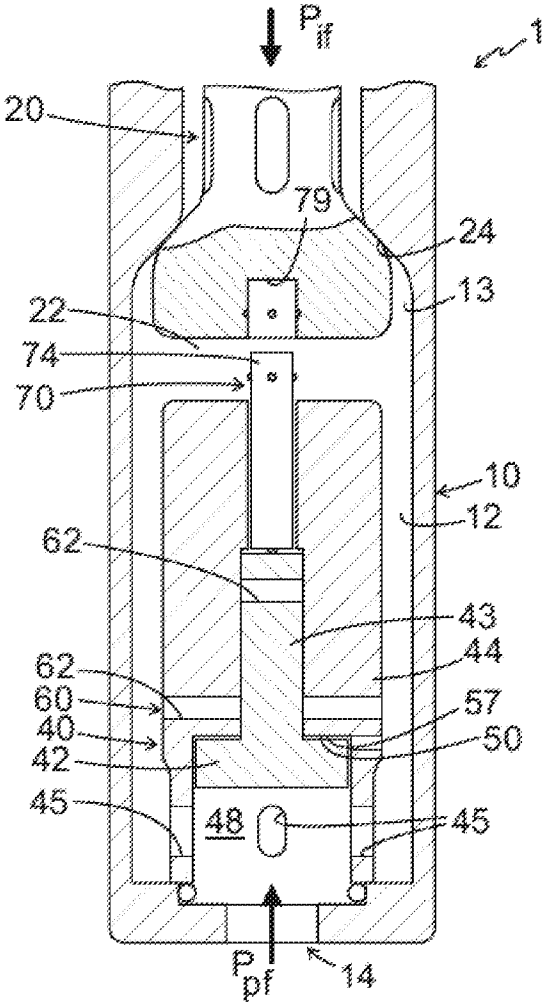
Figure 2A:
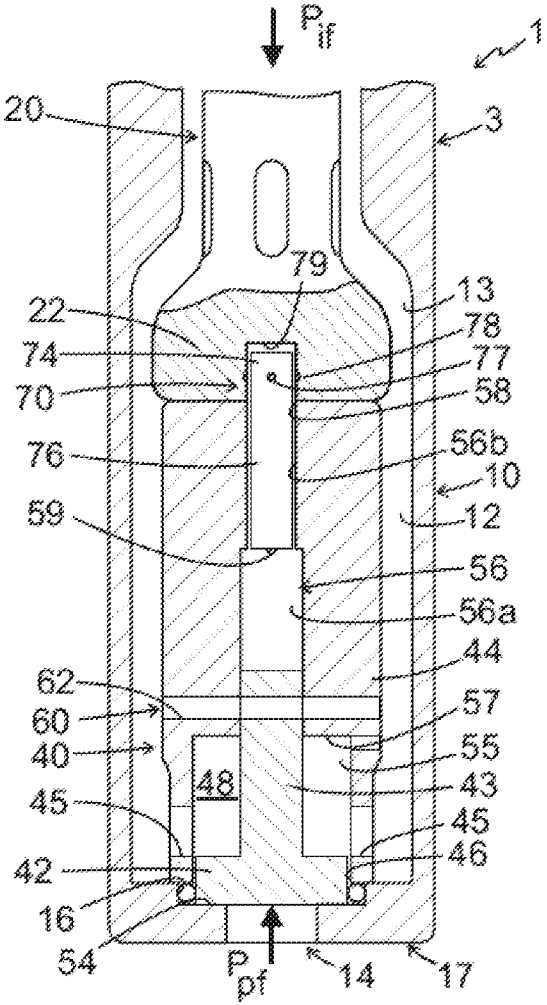

A second example of a valve arrangement is shown in FIGS. 2*a*-2*c*. The first valve device 20 is a dart check valve also in this example. When the second valve member 22 is in the locked and closed position, as shown in FIG. 2*a*, the second valve member 42 rests in a recess 16 provided on the inside of the outer housing 10, in a similar manner as in the first example. A valve seat 54 is arranged in the recess, possibly also including a seal member. The second valve member rests against the second valve seat in a sealing manner. The recess 16 communicates with the outlet opening 14. The second valve device 40 also comprises an inner housing 44 that is connected via an open end 46 to the inner wall of the outer housing 10, where the outlet opening is located. The open end of the inner housing can be described as enclosing the outlet opening 14, similar to the first example.

The interior 48 of the inner housing 44 comprises a through bore in the longitudinal direction comprising a first channel 55 and a second channel 56. The first channel 55 extends from the open end 46 of the inner housing, and said first channel is adapted to receive the second valve member 42 when the second valve member moves to its open position. The second valve member is thus movable inside the first channel 55. The first channel 55 may form a prolongation of the recess. When the second valve member is released from the locking device and opens it may thus move from the valve seat 54 and upwards inside the inner housing 4, in the first channel 55, until it reaches the inner end wall 57 of the inner channel, which inner end wall forms a first stop member 50. In analogy with the first example, fluid openings 45 are provided in the side walls of the inner housing 44. These fluid openings provide fluid communication between the interior 48 of the inner housing 44 and the surrounding interior 12 of the outer housing 10.

The second valve member 42 has a shaft 43 that extends from that side of the valve member that is opposite the side that faces the outlet opening 14. Thus, the shaft extends into the first channel 55, when the second valve member is closed, and also extends partly into the second channel 56 in the inner housing. The second channel 56 extends from the inner end wall 57 and to an opening 58 facing the first valve member 22. The second channel 56 comprises a first channel part 56*a* that has a length that essentially corresponds to the length of the shaft 43, and a second channel part 56*b* in which elements of a holding device 70 are arranged. The first channel part 56*a* is where the shaft 43 is inserted and movable.

The locking device 60 comprises at least one shear member 62 that connects the second valve member 42 to the inner housing 44. In this example, the locking device 60, by means of a shear member 62, connects the inner housing 44 and the second valve member 42, by means of the shaft 43. The connection between the inner housing and the shaft is obtained in the second channel 56. The shaft 43 extends so far into the second channel 56, when the second valve member is in the closed position, that a reliable locking engagement can be obtained between the shaft 43 and the inner housing, by means of the shear member 62. The shear member 62 may be inserted into respective corresponding grooves provided in the shaft 43 and the wall of the inner housing 44. In the FIGS. 2*a*-2*c* only one shear member is illustrated but there may be more than one shear member, e.g. as shown in FIGS. 1*a*-1*c*. In the illustrated example, the shear member is shown as a shear pin/screw, but also other types of shear members are possible, e.g. shear sleeve, shear plate, as realized by the skilled person and with only minor modifications, if necessary.

The first valve device 20 of the second example is the same as in the first example, but the details of the holding device 70 are different as will be explained more in detail later. Elements of the holding device may be arranged in the second channel part 56*b*, as previously mentioned.

As shown in the second example of FIGS. 2*a*-2*c*, the holding device 70 may comprise a releasable coupling 74. The releasable coupling may comprise a quick release coupling. For example it may comprise a coupling housing 76 installed in the second channel part 56*b*. Inside the coupling housing 76 is located an actuator 59 that can be activated by means of the shaft 43. The coupling housing 76 extends past the inner housing and into an interior part 13 of the outer housing where the first valve member 22 is located. The coupling is connectable to the first valve member 22, e.g. by means of pegs 77 that protrude at the end of the coupling housing and that can enter into engagement with grooves 78 provided in a recess 79 arranged for this purpose in an end face of the first valve member 22. Thereby, the first valve member 22 can be held and locked in an open position. The protruding pegs 77 are arranged to be retractable from engagement with the grooves 78 by means of the actuator 59.

In FIG. 2*a*, the second example of a valve arrangement is shown in a closed state. The second valve member 42 is locked in a closed position by means of the locking device 60 comprising the shear members 62. The first valve member 22 is shown as being in an open position, by means of the holding device 70 comprising the releasable coupling 74. In analogy with what has been described above in relation to the first example, when the predetermined pressure difference is reached, the shear member 62 will shear and the second valve member 42 will be released and pushed upwards/inwards, away from the outlet opening 14. Process fluid from the process fluid tubing can then enter into the outer housing 10, via the outlet opening 14 and the inner housing 44. The second valve member 42 moves upwards, inside the first channel 55 of the inner housing 44, until it abuts against the end wall 57 forming the first stop member 50. The shaft 43 simultaneously moves up inside the second channel 56 and hits the actuator 59 of the releasable coupling 74. The first valve member 22 is then released and can move to its closed position, as shown in FIG. 2*b*.

In FIG. 2*c* is illustrated the second example of the valve arrangement in its open state. The injection fluid pressure $P_{if}$ exceeds the process fluid pressure $P_{pf}$ and the first valve member 22 will be pushed down into the interior 12 of the outer housing 10, to its open position. Injection fluid can then continue to flow from the interior 12 of the outer housing into the inner housing 48, via the fluid openings 45, and further via the interior 48 of the inner housing out through the outlet opening 14 and into process tubing to which it is connected. This corresponds to the function as described above with regard to the first example. The releasable coupling 74 will remain in its released state as long as the shaft 43 presses on the actuator 59, and the first valve member will be free to move. In order to prevent that the shaft 43 moves away from the actuator, a second stop member 51 may be provided, for example in a similar manner as in the first example. The second stop member 51 may e.g. comprise a circlip or a lock ring such as a Seeger ring.

According to a possible alternative to the first and second examples, the described valve seat recess formed on the inside of the outer housing may be avoided and instead a corresponding valve seat may be configured as a part of the inner housing.

Figure 3:
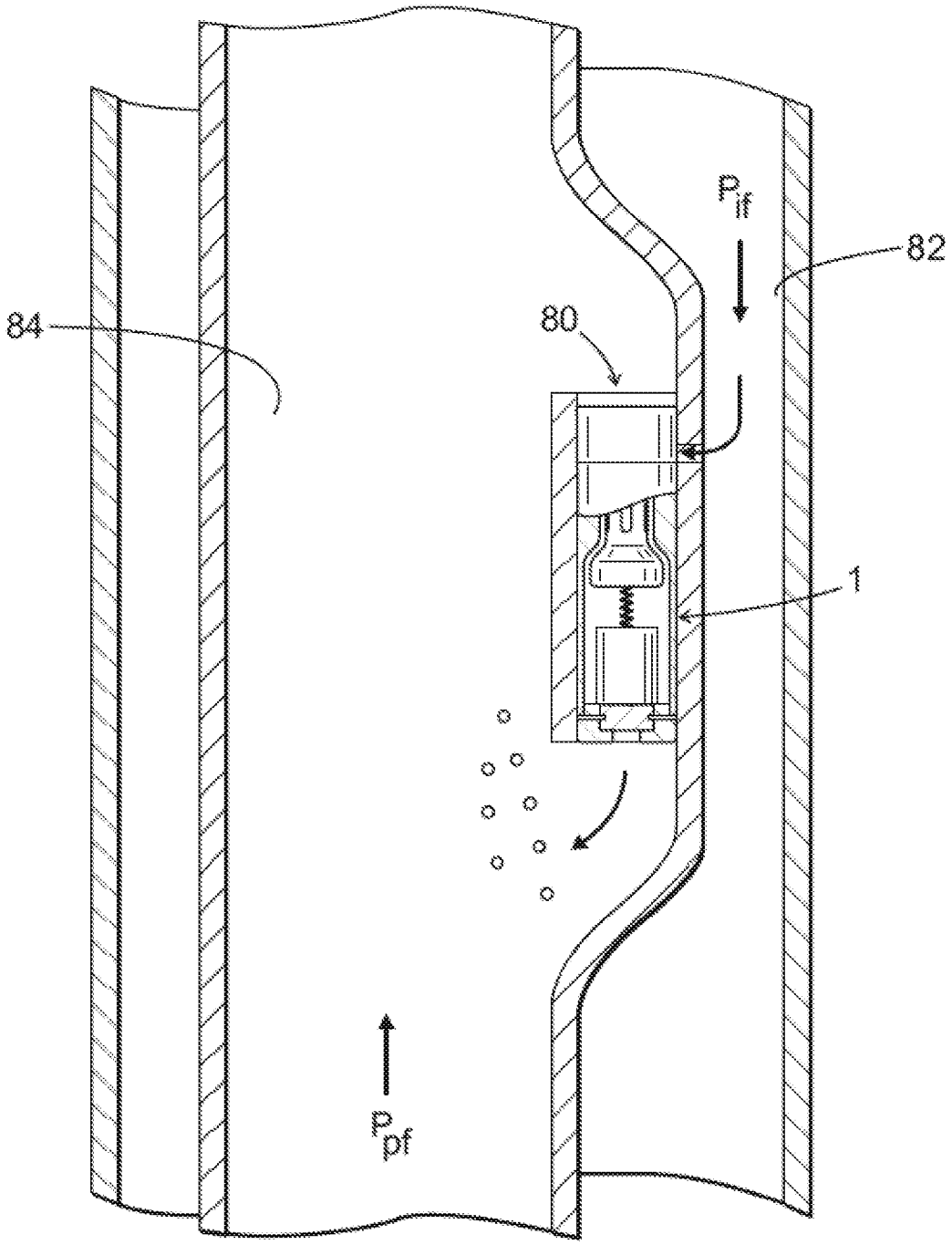
FIG. 3 illustrates schematically an example of a side pocket mandrel comprising a valve arrangement.
Figure 4:
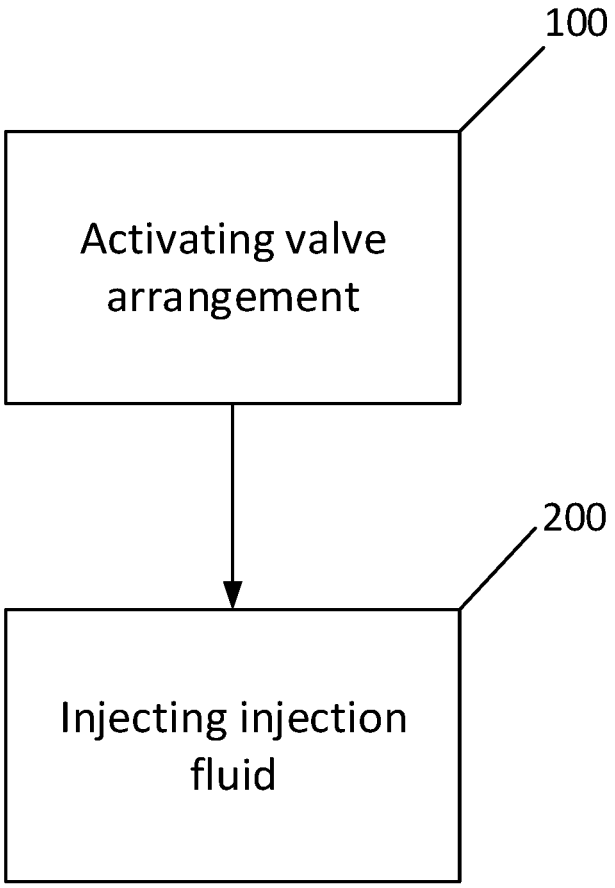
FIG. 4 shows a schematic diagram of an example method.

In FIG. 3 is shown a schematic drawing of an example of a side pocket mandrel 80 for use in a hydrocarbon well comprising an annulus 82 and a tubing 84. The side pocket mandrel comprises a valve arrangement 1 as described in any one of the examples herein, wherein the inlet part 3 connectable to an injection fluid source is connectable to the annulus 82 and the at least one outlet opening 14 is connectable to the tubing in the well.

A method is also provided for operating a valve arrangement according to what has been described above. The valve arrangement 1 is in a deactivated state in which the second valve member 42 is in its closed position, and which valve arrangement is connected via the inlet part to an injection fluid source and connected via the at least one outlet opening 14 to a process fluid tubing, comprising activating 100 the valve arrangement 1 by applying a process fluid pressure in the process fluid tubing to exert a process fluid pressure force on the second valve member 42, when a predetermined pressure difference between a fluid pressure $P_{oh}$ in the outer housing 10 and a fluid pressure in the process fluid tubing is reached, which fluid pressure $P_{pf}$ in the process fluid tubing exceeds the fluid pressure in the outer housing 10, and thereby releasing the locking device 70, whereby the second valve member 42 is released to move to the open position, injecting injection fluid 200 via the valve arrangement, comprising opening of the first valve member 22, into the process fluid tubing.

The different elements disclosed in this description, the following claims or the accompanying drawings, expressed in their specific forms or in terms a means for performing a disclosed function, or a method or process for attaining the disclosed result, may, separately or in any combination of such elements, be utilised for realising the present disclosure in diverse forms thereof.

The present disclosure shall not be considered limited to the illustrated examples, but can be modified and altered in many ways, as realised by a person skilled in the art, without departing from the scope defined in the appended claims. For examples, details from one example may in many cases be applicable also to other examples.

The invention claimed is:

1. A valve arrangement for injection of an injection fluid in a process fluid tubing, comprising:

an inlet part connectable to an injection fluid source, an outer housing connectable to a process fluid tubing and comprising at least one outlet opening that enables a fluid communication between an interior of the outer housing and the process fluid tubing, a first valve device comprising a first valve member that is arranged in the outer housing and movable within the outer housing in a longitudinal direction, wherein the first valve member is arranged to control an inflow of injection fluid into the valve arrangement by being movable between a closed position and an open position, a second valve device comprising a second valve member that is arranged in the outer housing and movable within the outer housing in the longitudinal direction, and the second valve member is arranged to control the at least one outlet opening by being movable between a closed position, in which the at least one outlet opening is closed and the valve arrangement is in a deactivated state in which injection fluid cannot be injected in the process fluid tubing, and an open position, in which the at least one outlet opening is open and the valve arrangement is in an activated state that enables injection of injection fluid into the process fluid tubing, and a locking device configured to lock the second valve member in the closed position, wherein the locking device is releasable in order to allow the second valve member to be released to move to the open position, wherein the locking device is configured to be released at a predetermined pressure difference between a fluid pressure $P_{oh}$ inside the outer housing and a fluid pressure $P_{gf}$ in the process fluid tubing, which fluid pressure in the process tubing exceeds the fluid pressure inside the outer housing.

2. The valve arrangement according to claim 1, wherein the locking device comprises at least one shear member configured to shear at a predetermined shear force.

3. The valve arrangement according to claim 1, wherein the at least one outlet opening in the outer housing is located in an end wall of the valve arrangement.

4. The valve arrangement according to claim 1, wherein the second valve device comprises at least one fluid opening that, when the second valve member is in the open position, provides a fluid communication between the process fluid tubing, via the at least one outlet opening, and the first valve member.

5. The valve arrangement according to claim 1, wherein the second valve device comprises an inner housing located inside the outer housing, wherein the second valve member is movable inside the inner housing.

6. The valve arrangement according to claim 5, wherein at least one first stop member is arranged in the inner housing, wherein against the at least one first stop member the second valve member abuts in the open position.

7. The valve arrangement according to claim 5, wherein the inner housing has an open end connected to the at least one outlet opening and wherein the inner housing comprises at least one fluid opening for allowing fluid communication between an interior of the inner housing and a surrounding interior of the outer housing.

8. A side pocket mandrel for use in a hydrocarbon well comprising an annulus and a tubing, the side pocket mandrel comprising a valve arrangement according to claim 1, wherein the inlet part connectable to an injection fluid source is connectable to the annulus and the at least one outlet opening is connectable to the tubing in the well.

9. A valve arrangement for injection of an injection fluid in a process fluid tubing, comprising:

an inlet part connectable to an injection fluid source, an outer housing connectable to the process fluid tubing and comprising at least one outlet opening that enables a fluid communication between an interior of the outer housing and the process fluid tubing, a first valve device comprising a first valve member that is arranged in the outer housing and movable within the outer housing in a longitudinal direction, wherein the first valve member is arranged to control an inflow of injection fluid into the valve arrangement by being movable between a closed position and an open position, a second valve device comprising a second valve member that is arranged in the outer housing and movable within the outer housing in the longitudinal direction, and the second valve member is arranged to control the at least one outlet opening by being movable between a closed position, in which the at least one outlet opening is closed and the valve arrangement is in a deactivated state in which injection fluid cannot be injected in the process fluid tubing, and an open position, in which the at least one outlet opening is open and the valve arrangement is in an activated state that enables injection of injection fluid into the process fluid tubing, a locking device configured to lock the second valve member in the closed position, wherein the locking device is releasable in order to allow the second valve member to be released to move to the open position, and a holding device configured to hold the first valve member in an open position when the valve arrangement is in the deactivated state.

10. The valve arrangement according to claim 9, wherein the holding device couples the first valve member to the second valve device.

11. The valve arrangement according to claim 9, wherein the holding device comprises a connector that connects the first valve member and the second valve member.

12. The valve arrangement according to claim 11, wherein the connector is a resilient connector.

13. The valve arrangement according to claim 9, wherein the holding device comprises a releasable coupling that couples the first valve member to the inner housing when the valve arrangement is in the deactivated state.

14. The valve arrangement according to claim 13, wherein the releasable coupling is configured to be releasable by means of the second valve member, when the second valve member moves to its open position.

15. A method for operating a valve arrangement wherein the valve arrangement comprises:

an inlet part connectable to an injection fluid source, an outer housing connectable to a process fluid tubing and comprising at least one outlet opening that enables a fluid communication between an interior of the outer housing and the process fluid tubing, a first valve device comprising a first valve member that is arranged in the outer housing and movable within the outer housing in a longitudinal direction, wherein the first valve member is arranged to control an inflow of injection fluid into the valve arrangement by being movable between a closed position and an open position, a second valve device comprising a second valve member that is arranged in the outer housing and movable within the outer housing in the longitudinal direction, and the second valve member is arranged to control the at least one outlet opening by being movable between a closed position, in which the at least one outlet opening is closed and the valve arrangement is in a deactivated state in which injection fluid cannot be injected in the process fluid tubing, and an open position, in which the at least one outlet opening is open and the valve arrangement is in an activated state that enables injection of injection fluid into the process fluid tubing, and a locking device configured to lock the second valve member in the closed position, wherein the locking device is releasable in order to allow the second valve member to be released to move to the open position, wherein the method comprising:

activating the valve arrangement by applying a process fluid pressure in the process fluid tubing to exert a process fluid pressure force on the second valve member, wherein, when a predetermined pressure difference between a fluid pressure $P_{oh}$ in the outer housing and a fluid pressure $P_{pf}$ in the process fluid tubing is reached, which fluid pressure in the process fluid tubing exceeds the fluid pressure in the outer housing, the locking device is released and the second valve member is released to move to the open position, injecting injection fluid via the valve arrangement into the process fluid tubing, comprising opening of the first valve member.

* * * * *